US009248551B2

(12) United States Patent
Nakayama et al.

(10) Patent No.: US 9,248,551 B2
(45) Date of Patent: Feb. 2, 2016

(54) NONWOVEN FABRIC POLISHING ROLL AND METHOD OF MANUFACTURING SAME

(75) Inventors: Masashi Nakayama, Sagamihara (JP); Akira Yoda, Machida (JP)

(73) Assignee: 3M Innovative Properties Company, St. Paul, MN (US)

( * ) Notice: Subject to any disclaimer, the term of this patent is extended or adjusted under 35 U.S.C. 154(b) by 135 days.

(21) Appl. No.: 13/982,772

(22) PCT Filed: Jan. 26, 2012

(86) PCT No.: PCT/US2012/022670

§ 371 (c)(1),
(2), (4) Date: Oct. 10, 2013

(87) PCT Pub. No.: WO2012/106173

PCT Pub. Date: Aug. 9, 2012

(65) Prior Publication Data

US 2014/0038502 A1 Feb. 6, 2014

(30) Foreign Application Priority Data

Feb. 1, 2011 (JP) ..... 2011-019976

(51) Int. Cl.

| | |
|---|---|
| ***B24D 13/08*** | (2006.01) |
| ***B24D 13/02*** | (2006.01) |
| ***B24D 18/00*** | (2006.01) |
| ***B24D 13/20*** | (2006.01) |

(52) U.S. Cl.

CPC ..... *B24D 13/08* (2013.01); *B24D 13/02* (2013.01); *B24D 13/20* (2013.01); *B24D 18/0009* (2013.01); *B24D 18/0072* (2013.01); *Y10T 156/10* (2015.01)

(58) Field of Classification Search

CPC ..... B24D 13/08; B24D 13/02; B24D 13/04; B24D 13/10

See application file for complete search history.

(56) References Cited

U.S. PATENT DOCUMENTS

| | | | | |
|---|---|---|---|---|
| 5,127,123 | A * | 7/1992 | Belanger | 15/53.4 |
| 5,560,744 | A * | 10/1996 | Schaffner, III | 451/490 |
| 5,765,256 | A * | 6/1998 | Allan et al. | 15/230.12 |

FOREIGN PATENT DOCUMENTS

| | | |
|---|---|---|
| JP | 36-30790 | 11/1936 |
| JP | 49-124692 | 11/1974 |

(Continued)

OTHER PUBLICATIONS

International Search Report for PCT International Application No. PCT/US2012/022670, mailed on Aug. 24, 2012, 3 pages.

*Primary Examiner* — Monica Carter
*Assistant Examiner* — Lauren Beronja
(74) *Attorney, Agent, or Firm* — Scott A. Baum; David B. Patchett

(57) ABSTRACT

To provide a nonwoven fabric polishing roll that can reduce the occurrence of polishing defects and carry out uniform polishing. A nonwoven fabric polishing roll having a through hole in to which a rotation shaft of a polishing machine is inserted, and the internal surface of the through hole engages with the rotation shaft so that the torque of the rotation shaft is transmitted, the nonwoven fabric polishing roll comprising: a plurality of circular nonwoven fabrics having an aperture in the center thereof that forms the through hole; and a plurality of circular plates having an aperture in the center thereof that forms the through hole, and having an outer diameter that is smaller than the outer diameter of the circular nonwoven fabric, wherein the plurality of circular nonwoven fabric and the plurality of the circular plates are stacked so that one or two or more of the circular nonwoven fabrics are sandwiched on their aperture side by the circular plates, and bonded together with adhesive while compressed in the stacking direction, and the compression deformation ratio of the circular plates with respect to pressure forces from a direction normal to the stacking direction is smaller than that of the circular nonwoven fabric.

12 Claims, 14 Drawing Sheets

(56) References Cited

FOREIGN PATENT DOCUMENTS

| | | |
|---|---|---|
| JP | 56-095581 | 8/1981 |
| JP | 57-008082 | 1/1982 |
| JP | S60-120766 | 6/1985 |
| JP | 04-73463 | 6/1992 |
| JP | 09-201232 | 8/1997 |
| WO | WO 97-27029 | 7/1997 |
| WO | WO 2007139097 A1 * | 12/2007 |

* cited by examiner

NONWOVEN FABRIC POLISHING ROLL AND METHOD OF MANUFACTURING SAME

CROSS REFERENCE TO RELATED APPLICATIONS

This application is a national stage filing under 35 U.S.C. 371 of PCT/US2012/022670 filed Jan. 26, 2012, which claims priority to Japanese Patent Application No. 2011-019976, filed Feb. 1, 2011, the disclosures of which are incorporated by reference in their entirety herein.

FIELD OF INVENTION

The present invention relates to a nonwoven fabric polishing roll and a method of manufacturing same.

BACKGROUND

Conventionally a cylindrical polishing roll in which a through hole is formed into which the rotation shaft (spindle) of a rotating tool is inserted is used as a polishing roll for polishing the surface of metal strip and the like (for example, Patent Document 1: Japanese Unexamined Patent Application Publication No. H9-201232). Laminated forms, flap forms, and convoluted forms of these polishing rolls, as illustrated in FIG. 5 of Patent Document 1, for example, are known as this type of polishing roll.

The polishing roll disclosed in Patent Document 1 is mainly a stacked form of polishing roll, and has a construction wherein a disk sheet laminate is compressed in the stacking direction, and adhesive is hardened (see FIG. 4 and so on of Patent Document 1). Also, Patent Document 1 proposes the manufacture of a compressed and hardened polishing disk brush in which the brush base member is a uniform density using a special manufacturing method.

SUMMARY OF THE INVENTION

However, conventionally, when the surface of metal strip and the like is polished using a polishing roll such as that disclosed in Patent Document 1, periodic polishing defects such as chatter marks can occur, even though the brush base member is compressed and hardened to a uniform density.

It is an object of the present invention to provide a nonwoven fabric polishing roll and manufacturing method of same that is capable of highly uniform polishing and suppressing the occurrence of the above polishing defects. Also, it is an object of the present invention to provide a polishing machine that includes the nonwoven fabric polishing roll and a method of manufacturing a polished article using the nonwoven fabric polishing roll.

In a polishing roll such as that disclosed in Patent Document 1, normally key grooves that engage with keys provided on the rotation shaft of a rotating tool are provided in the through hole into which the rotation shaft is inserted. The inventors arrived at the present invention by discovering that the distance from the outer periphery of the polishing roll to the through hole (in other words, the thickness of the nonwoven fabric) was different at the portions where the key groove was provided and the portions where the key groove was not provided, and that this was a cause of the occurrence of polishing defects.

The present invention provides a nonwoven fabric polishing roll having a through hole in to which a rotation shaft of a polishing machine is inserted, and the internal surface of the through hole engages with the rotation shaft so that the torque of the rotation shaft is transmitted, the nonwoven fabric polishing roll comprising: a plurality of circular nonwoven fabrics having an aperture in the center thereof that forms the through hole; and a plurality of circular plates having an aperture in the center thereof that forms the through hole and having an outer diameter that is smaller than the outer diameter of the circular nonwoven fabric, wherein the plurality of circular nonwoven fabrics and the plurality of the circular plates are stacked so that one or two or more of the circular nonwoven fabrics are sandwiched on their aperture sides by the circular plates, and bonded together with adhesive while compressed in the stacking direction, and the compression deformation ratio of the circular plates with respect to pressure forces from a direction normal to the stacking direction is smaller than that of the circular nonwoven fabric.

In a conventional polishing roll, the shape of the through hole as described above will affect the polishing performance at the outer periphery and cause polishing defects, but in the nonwoven fabric polishing roll according to the present invention, the circular plates, whose compression deformation ratio due to pressure in a direction normal to the stacking direction is small, are stacked so as to sandwich the aperture sides of the circular nonwoven fabrics, so the polishing performance at the outer periphery is not affected by the shape of the through hole, but by the shape of the circular plates. Also, the circular nonwoven fabrics that form the outer periphery and the circular plates that are stacked on their aperture sides each have a circular shape with an aperture in the center, so the effect at the outer periphery of the shape of the circular plate is sufficiently uniform. Therefore, according to the present invention, it is possible to sufficiently suppress the occurrence of periodic polishing defects such as chatter marks and the like, and it is possible to carry out uniform polishing.

Also, in the nonwoven fabric polishing roll according to the present invention, the circular nonwoven fabrics and the circular plates are bonded to each other with adhesive while being compressed in the stacking direction, so it is possible to polish objects to be polished having a high hardness using a high polishing load.

In the nonwoven fabric polishing roll according to the present invention, the total thickness of the stacked circular plates per meter in the stacking direction is from 10 to 60 cm. In this way, it is possible to further reduce the effect of the shape of the through hole on the polishing performance at the outer periphery, so more uniform polishing is possible.

In the nonwoven fabric polishing roll according to the present invention, the circular plates are stacked at approximately equal intervals. Such a nonwoven fabric polishing roll is capable of sufficiently suppressing the occurrence of unevenness of polishing performance in the stacking direction. Here, it is sufficient that the circular plates are stacked at approximately equal intervals over the range in the stacking direction of the nonwoven fabric polishing roll where there is contact with the object to be polished, it is not necessary that they are stacked at approximately equal intervals over the whole nonwoven fabric polishing roll.

In the nonwoven fabric polishing roll according to the present invention, the shortest distance from the aperture of the circular plate to the outer periphery of the circular plate is greater than or equal to 5 mm. According to this type of circular plate, the low deformability cylindrical construction as described later can be more reliably formed, so the occurrence of polishing defects can be further reduced, and polishing can be carried out more uniformly.

The present invention also provides a method of manufacturing a nonwoven fabric polishing roll having a through hole into which a rotation shaft of a polishing machine is inserted, and the internal surface of the through hole engages with the rotation shaft so that the torque of the rotation shaft is transmitted, the method comprising: a stacking process of stacking a plurality of circular nonwoven fabrics having an aperture in the center thereof that forms the through hole and a plurality of circular plates having an aperture in the center thereof that forms the through hole so that one or two or more of the circular nonwoven fabrics are sandwiched on their aperture side by the circular plates; and a bonding process of bonding together the circular nonwoven fabric and circular plates that were stacked in the stacking process with adhesive while compressed in the stacking direction, wherein the circular plates have an outer diameter smaller than the outer diameter of the circular nonwoven fabric, and a compression deformation ratio with respect to pressure forces from a direction normal to the stacking direction smaller than that of the circular nonwoven fabric.

According to the nonwoven fabric polishing roll manufacturing method of the present invention, it is possible to easily manufacture the nonwoven fabric polishing roll according to the present invention.

The nonwoven fabric polishing roll manufacturing method according to the present invention may also include an impregnating process of impregnating the circular nonwoven fabric with adhesive prior to the stacking process. According to this manufacturing method, the circular nonwoven fabrics are uniformly impregnated with adhesive, so when bonding in the bonding process, the hardened adhesive is more uniformly distributed. Therefore, the polishing performance of a nonwoven fabric polishing roll manufactured by this manufacturing method is further improved.

The present invention also provides a polishing machine that includes the nonwoven fabric polishing roll according to the present invention. This polishing machine includes the nonwoven fabric polishing roll according to the present invention, so the occurrence of polishing defects such as chatter marks or the like is sufficiently suppressed, so it is possible to polish the object to be polished very uniformly.

The present invention also provides a method of manufacturing a polished article that includes a process of polishing the object to be polished using the nonwoven fabric polishing roll according to the present invention. According to this manufacturing method, it is possible to manufacture a uniformly polished article, while sufficiently suppressing the occurrence of polishing defects such as chatter marks.

According to the present invention, it is possible to provide a nonwoven fabric polishing roll and manufacturing method of same that can reduce the occurrence of polishing defects and carry out highly uniform polishing.

DETAILED DESCRIPTION OF THE INVENTION

Figure 1:
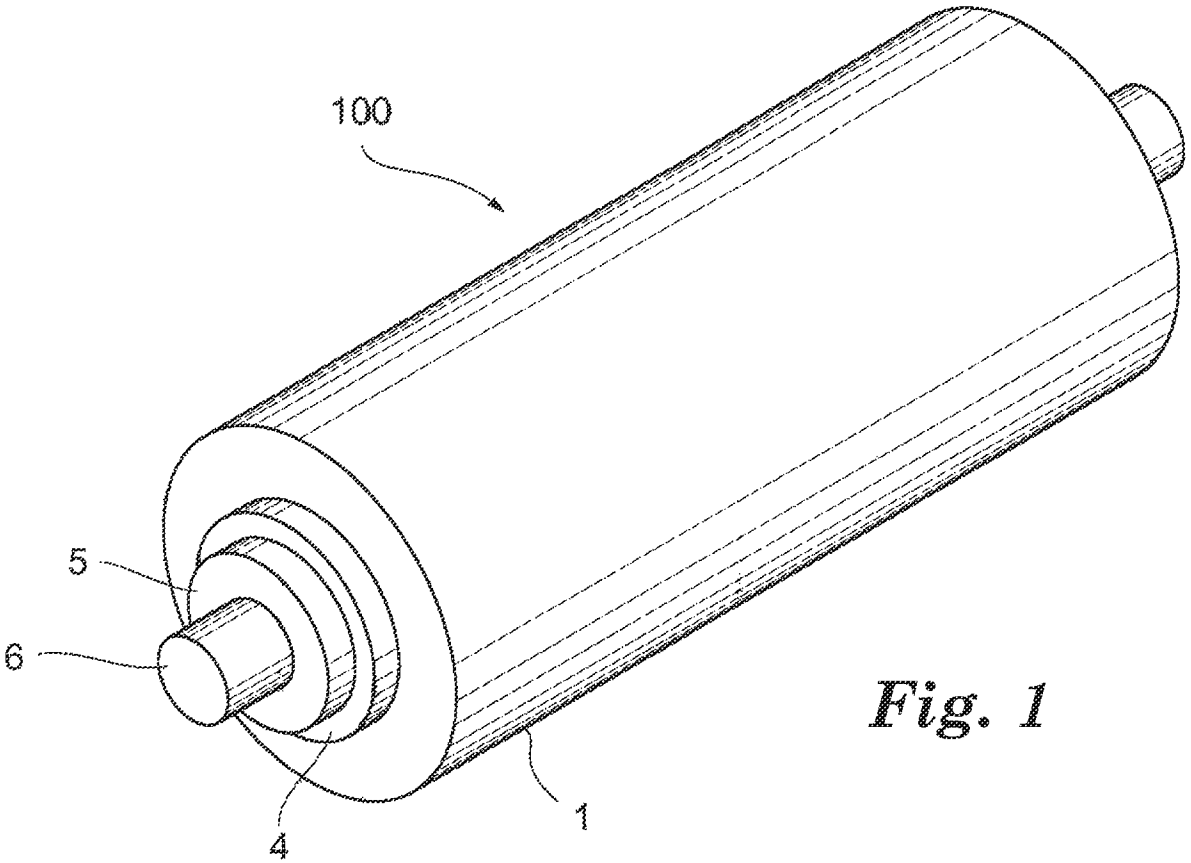
FIG. 1 is a view illustrating the state with a rotation shaft inserted into the nonwoven fabric polishing roll according to the present invention.

The following is a detailed explanation of the preferred embodiments of the present invention, with reference to the drawings. In the following explanation, the same or corresponding elements are given the same reference numeral, and duplicate explanations are omitted.

Figure 2:
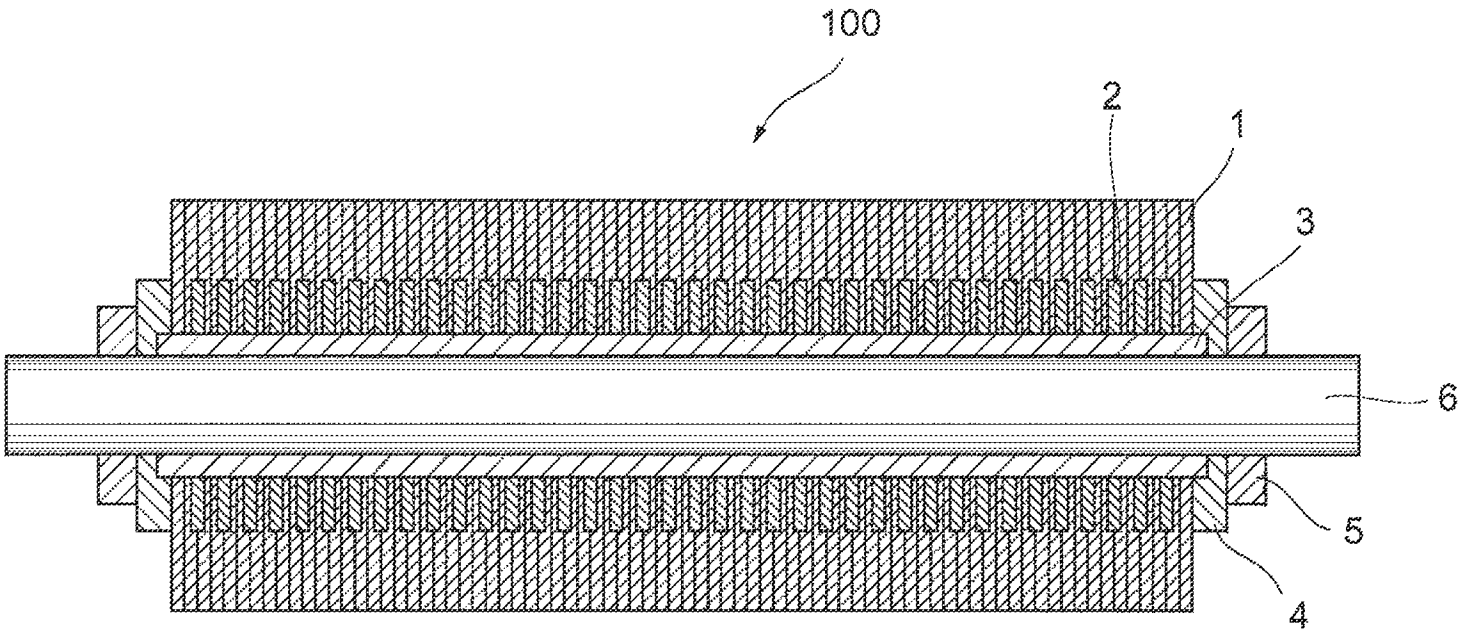
FIG. 2 is a view illustrating the state with the rotation shaft inserted into the nonwoven fabric polishing roll according to the present invention.

FIGS. 1 and 2 are views illustrating the state with a rotation shaft 6 inserted into a nonwoven fabric polishing roll 100 according to the present invention. In FIGS. 1 and 2, the nonwoven fabric polishing roll 100 has a through hole through which the rotation shaft 6 of a polishing machine is inserted. The rotation shaft 6 has key projections 3 to transmit torque to the nonwoven fabric polishing roll 100, and the through hole of the nonwoven fabric polishing roll 100 has a shape to engage with the rotation shaft 6 including the key projections 3.

The nonwoven fabric polishing roll 100 has a cylindrical construction wherein circular nonwoven fabrics 1 and circular plates 2 each having central apertures are stacked, and the through hole is formed as a result of the apertures in the circular nonwoven fabric 1 and the circular plate 2. The circular plate 2 has an external diameter smaller than that of the circular nonwoven fabric 1, and two circular plates 2 are stacked sandwiching the aperture sides of two circular nonwoven fabrics 1. Then the circular nonwoven fabrics 1 and the circular plates 2 are bonded with adhesive while compressed in the stacking direction.

Here, in the nonwoven fabric polishing roll 100, two circular plates 2 are stacked sandwiching two circular nonwoven fabrics 1, but the stacking form is not limited to this.

For example, the circular plates 2 may be stacked sandwiching a single circular nonwoven fabric 1, or they may be stacked sandwiching three or more circular nonwoven fabrics 1.

The total thickness of circular plates 2 per meter length of the nonwoven fabric polishing roll 100 in the stacking direction is preferably from 10 to 60 cm, and more preferably 25 through 45 cm. By stacking the circular plates at this rate, it is possible to further reduce the effect of the shape of the through hole on the polishing performance at the outer periphery, so more uniform polishing is possible. To realize this total thickness, the number of stacked circular plates 2 can be, for example, from 50 to 300 per meter in the stacking direction.

In the nonwoven fabric polishing roll 100, the circular plates 2 are stacked at approximately the same intervals. Here, it is not necessary to stack the circular plates 2 at equal intervals; for example, there may be locations where the circular plates 2 are stacked sandwiching a single circular nonwoven fabric 1, and locations where they are stacked sandwiching two or more circular nonwoven fabrics 1. Preferably the circular plates 2 are stacked at approximately equal intervals, so that the polishing performance in the stacking direction is still more uniform. Here, approximately equal intervals means, for example, a plurality of circular plates 2 is stacked so that they each sandwich the same number of circular nonwoven fabrics 1.

In the nonwoven fabric polishing roll 100, the two ends of the stacked cylindrical construction of the circular nonwoven fabrics 1 and the circular plates 2 are fixed in the direction parallel to the rotation shaft 6 by a flange 4 and a lock nut 5.

Preferably the external diameter of the circular plates 2 is smaller than the external diameter of the flange 4. The limiting usable diameter of the nonwoven fabric polishing roll 100 depends on the larger of the external diameter of the circular plates 2 and the external diameter of the flange 4. When the external diameter of the circular plates 2 is larger than the external diameter of the flange 4, it is difficult to visually check the limiting usable diameter. On the other hand, when the external diameter of the circular plates 2 is smaller than the external diameter of the flange 4, it is possible to visually check the limiting usable diameter.

In the nonwoven fabric polishing roll 100, the compression deformation ratio $T_2$ of the circular plates 2 due to pressure in a direction normal to the stacking direction is smaller than the compression deformation ratio $T_1$ of the circular nonwoven fabrics 1 due to pressure in a direction normal to the stacking direction. Here, the compression deformation ratio $T_1$ and $T_2$ is the compression deformation ratio in the state when compressed in the stacking direction and fixed with adhesive, and is a value obtained by a testing method for the compression deformation ratio that is described later.

In a conventional polishing roll, there is a danger that the shape of the through hole as described above will affect the polishing performance at the outer periphery and cause polishing defects, but in the nonwoven fabric polishing roll 100, the circular plates 2, whose compression deformation ratio due to pressure in a direction normal to the stacking direction is small, are stacked so as to sandwich the aperture sides of the circular nonwoven fabrics 1, so the polishing performance at the outer periphery is not affected by the shape of the through hole, but by the shape of the circular plates 2. Also, the circular nonwoven fabrics 1 that form the outer periphery and the circular plates 2 that are stacked on their aperture sides each have a circular shape with an aperture in the center, so the effect at the outer periphery of the shape of the circular plate 2 is sufficiently uniform. Therefore, according to the nonwoven fabric polishing roll 100, it is possible to sufficiently suppress the occurrence of periodic polishing defects such as chatter marks and the like, and it is possible to carry out highly uniform polishing.

The above effect is obtained even when a plurality of circular nonwoven fabrics 1 is stacked between circular plates 2 (when the circular plates 2 are stacked at equal intervals). The reason for this is considered to be as follows. Namely, the inner periphery part of the circular nonwoven fabrics 1 (the part sandwiched by the circular plates 2) is compressed more than the outer periphery part, so it is considered that the compression deformation ratio is smaller than that of the outer periphery part. Therefore, the inner periphery part of the circular nonwoven fabrics 1 is constituted from the circular plates 2 and the highly compressed circular nonwoven fabrics 1, forming a cylindrical shape with a low deformability construction, so it is considered that the effect of the shape of the through hole such as the keys and so on, which is a main cause of the effect on the polishing performance of the outer periphery part, is reduced.

Also, in the nonwoven fabric polishing roll 100, the circular nonwoven fabrics 1 and the circular plates 2 are bonded to each other with adhesive while being compressed in the stacking direction, so it is possible to polish objects to be polished having a high hardness using a high polishing load.

The nonwoven fabric density at the outer periphery part of the nonwoven fabric polishing roll 100 is preferably from 0.1 to 1.0 g/cm$^3$, and more preferably from 0.3 to 0.8 g/cm$^3$. When the nonwoven fabric density is in the above range, it is possible to polish with a higher polishing load. The nonwoven fabric density can be obtained by measuring the mass per unit volume.

In the nonwoven fabric polishing roll 100, the circular plates 2 are stacked over the whole stacking direction, so the above effect can be obtained when polishing an object to be polished in any position of the nonwoven fabric polishing roll 100. When the object being polished only touches a part of the nonwoven fabric polishing roll 100, it is not necessary that the circular plates 2 be stacked over the whole stacking direction of the nonwoven fabric polishing roll 100, but the circular plates 2 may be stacked over only the area in contact with the object being polished.

Method of Measurement of the Compression Deformation Ratio $T_1$

Figure 7B:
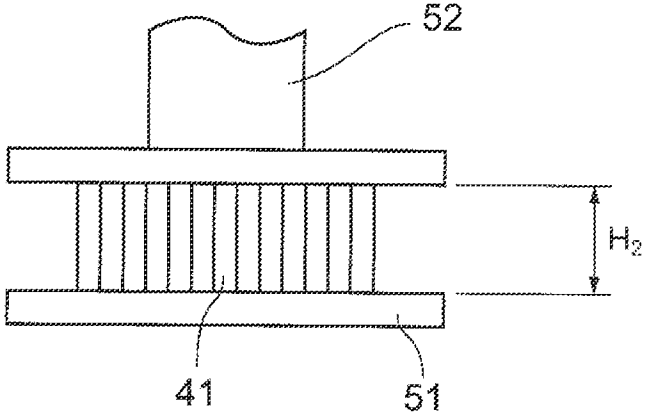
FIG. 7 is a schematic view illustrating the method of measuring the compression deformation ratio $T_1$.
Figure 7A:
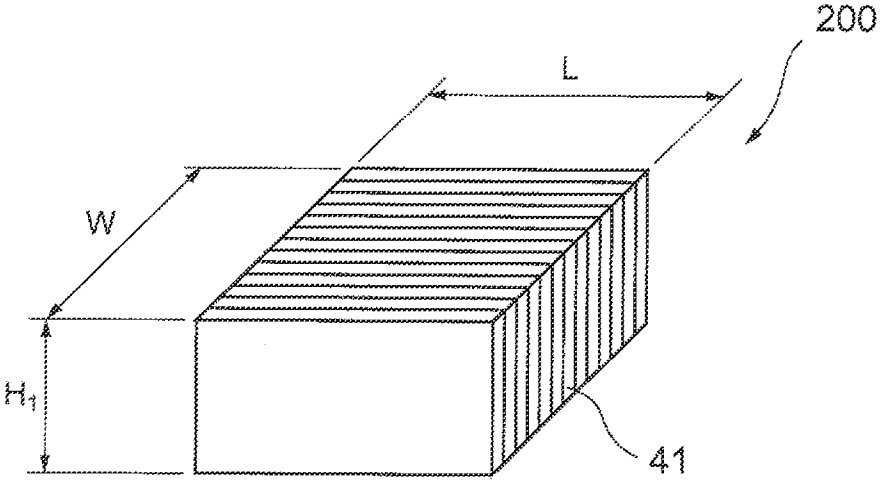

FIG. 7 is a schematic view illustrating a method of measuring the compression deformation ratio $T_1$. To measure the compression deformation ratio $T_1$, first a test block 200 with height $H_1$, width W, and length L is prepared, as illustrated in FIG. 7A. The test block 200 is a stack of a plurality of rectangular nonwoven fabrics 41 of the same material as the circular nonwoven fabric 1, and the rectangular nonwoven fabrics 41 of the test block 200 are bonded together with adhesive under compression in the stacking direction, the same as for the circular nonwoven fabrics 1. The test block 200 is compressed and bonded so that the nonwoven fabric density the same as the nonwoven fabric density of the outer periphery part of the nonwoven fabric polishing roll 100.

Next, as illustrated in FIG. 7B, the test block 200 is placed on an installation platform 51, and compressed in the height direction in a compression machine 52 with a compression load of 1 N/mm$^2$, and after compression the height $H_2$ is measured. Then from the height $H_1$ before compression and the height $H_2$ after compression, the compression deformation ratio $T_1$ is obtained by the following Equation (I).

$$T_1=(H_1-H_2)\times 100/H_i \quad \text{(I)}$$

Method of Measurement of the Compression Deformation Ratio $T_2$

For the compression deformation ratio $T_2$, instead of the test block 200, a test block is prepared by stacking and bonding of a plurality of rectangular plates of the same material as the circular plates 2, having a height $H_3$, width W, and length L. Normally the test block is compressed and bonded under the same conditions as the test block 200 in the method of measuring the compression deformation ratio $T_1$ as described above, but when the circular plates 2 are made from a material that does not compress when compressed in stacking direction (when it is considered that there would be no variation in the compression deformation ratio $T_2$ with or without compression), the test block may be prepared by simply stacking and bonding the rectangular plates.

Next, the test block is placed on the installation platform 51 as in the method of measurement of the compression deformation ratio $T_1$, and compressed in a compression machine 52 with a compression load of 1 N/mm$^2$, and after compression the height $H_4$ is measured. Then from the height $H_3$ before compression and the height $H_4$ after compression, the compression deformation ratio $T_2$ is obtained by the following Equation (II).

$$T_2=(H_3-H_4)\times 100/H_3 \quad \text{(II)}$$

The compression deformation ratio $T_1$ is smaller the higher the nonwoven fabric density. It is necessary that the compression deformation ratio $T_2$ be smaller than the compression deformation ratio $T_1$, preferably less than or equal to 2%, more preferably less than or equal to 1.8%, and most preferably less than or equal to 1.6%.

FIG. 3 is a schematic view illustrating examples of circular nonwoven fabric according to the present invention, and FIG. 4 is a schematic view illustrating examples of circular plate according to the present invention.

Figures 3A, 3B, 3C:
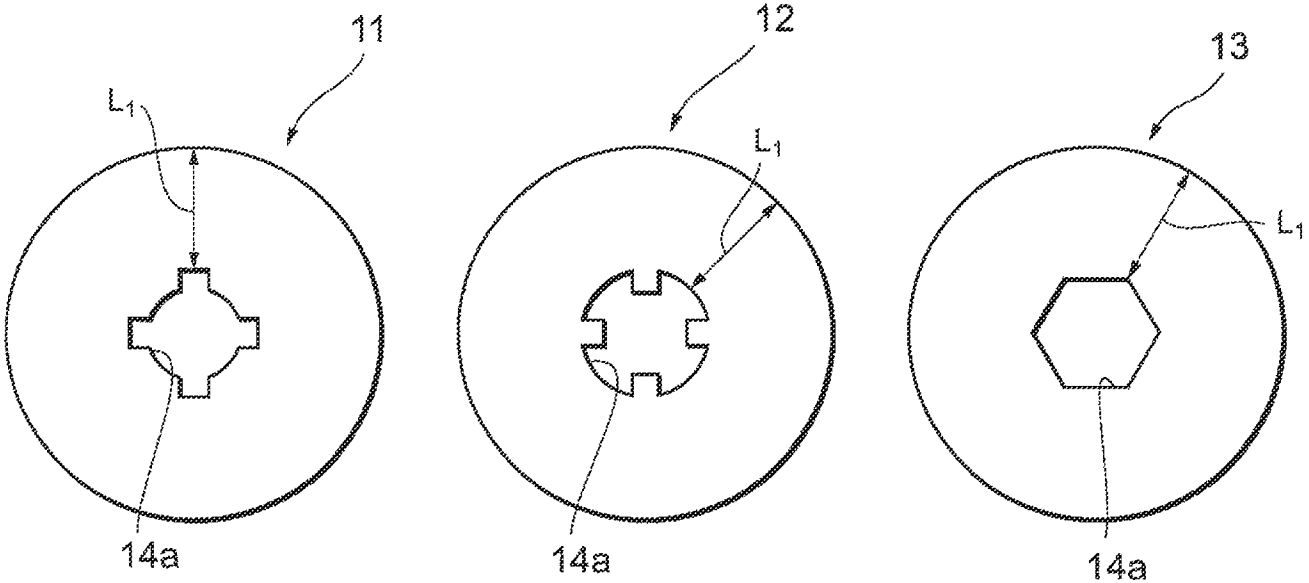
FIG. 3 is a schematic view illustrating examples of circular nonwoven fabric according to the present invention.
Figure 4A:
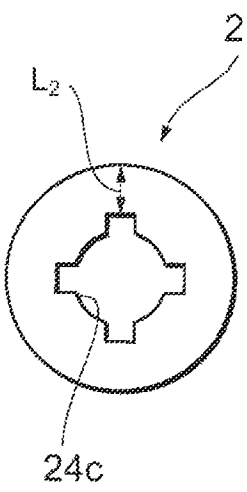
FIG. 4 is a schematic view illustrating examples of circular plates according to the present invention.

A circular nonwoven fabric 11 in FIG. 3A is used in combination with a circular plate 21 in FIG. 4A. The circular nonwoven fabric 11 has an aperture 14*a* in the center. Also, the circular plate 21 has an aperture 24*a* in the center. The aperture 14*a* and the aperture 24*a* have approximately the same shape, and when the circular nonwoven fabric 11 and the circular plate 21 are stacked, a through hole into which the rotation shaft of the polishing machine is inserted is formed by the aperture 14*a* and the aperture 24*a*. In other words, the aperture 14*a* and the aperture 24*a* have approximately the same shape as the cross-sectional shape of the rotation shaft of the polishing machine, and they each have key grooves that engage with the key projections on the rotation shaft.

Figure 4B:
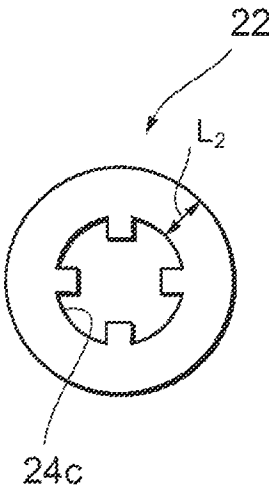

A circular nonwoven fabric 12 in FIG. 3B is used in combination with a circular plate 22 in FIG. 4B. The circular nonwoven fabric 12 has an aperture 14*b* in the center. Also, the circular plate 22 has an aperture 24*b* in the center. The aperture 14*b* and the aperture 24*b* have approximately the same shape, and when the circular nonwoven fabric 12 and the circular plate 22 are stacked, a through hole into which the rotation shaft of the polishing machine is inserted is formed by the aperture 14*b* and the aperture 24*b*. In other words, the aperture 14*b* and the aperture 24*b* have approximately the same shape as the cross-sectional shape of the rotation shaft of the polishing machine, and the circular nonwoven fabric 12 and the circular plate 22 have key grooves that engage with the key projections on the rotation shaft.

Figure 4C:
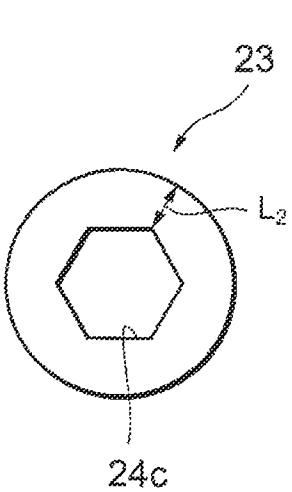

A circular nonwoven fabric 13 in FIG. 3C is used in combination with a circular plate 23 in FIG. 4C. The circular nonwoven fabric 13 has an aperture 14*c* in the center. Also, the circular plate 23 has an aperture 24*c* in the center. The aperture 14*c* and the aperture 24*c* have approximately the same shape, and when the circular nonwoven fabric 13 and the circular plate 23 are stacked, a through hole into which the rotation shaft of the polishing machine is inserted is formed by the aperture 14*c* and the aperture 24*c*. In other words, the aperture 14*c* and the aperture 24*c* have approximately the same shape as the cross-sectional shape of the rotation shaft of the polishing machine. In the circular nonwoven fabric 13 and the circular plate 23, the aperture 14*c* and the aperture 24*c* have a hexagonal shape, so they are used to manufacture nonwoven fabric polishing rolls for installation in a polishing machine with a rotation shaft with a hexagonal cross-sectional shape.

The shapes of the aperture of the circular nonwoven fabric and the aperture of the circular plate are not limited to the shapes illustrated in FIG. 3 and FIG. 4, for example, the shape may be triangular or square, and so on, or it may have a shape to engage with a rotation shaft that has one or two or more key projections, or it may have a shape to engage with a rotation shaft with one or two or more key grooves. The effect of the present invention as described above will be obtained, regardless of the shape of the aperture.

There is no particular limitation on the external diameter of the circular plate provided it is smaller than the external diameter of the circular nonwoven fabric, for example, the shortest distance $L_2$ from the aperture of the circular plate to the outer periphery of the circular plate can be greater than or equal to 5 mm. By making the shortest distance $L_2$ greater than or equal to 5 mm, the low deformability cylindrical construction as described above can be more reliably formed, so the occurrence of polishing defects can be further reduced, and polishing can be carried out more uniformly. If the shortest distance $L_2$ is greater than or equal to 5 mm, it is possible to obtain a circular plate with sufficient strength with any of the materials described later.

The shortest distance $L_2$ can also be from 5 to 100 mm. When the nonwoven fabric polishing roll 100 is used in polishing, only the outer periphery part constituted by the circular nonwoven fabric 1 is gradually worn, but it is possible to stop using the nonwoven fabric polishing roll 100 just before reaching the inner periphery part where the circular nonwoven fabric 1 and circular plate 2 are stacked. Therefore, by making the shortest distance $L_2$ less than or equal to 100 mm, it is possible to reduce the outer periphery part that can be used, and reduce the minimum usable diameter.

Also, the thickness of the circular plate can be from 1 to 5 mm. By making the thickness of the circular plate in the above range, the density of the circular nonwoven fabric in the outer periphery part of the nonwoven fabric polishing roll can be sufficiently high, and the strength of the circular plate can be sufficiently high, so a good nonwoven fabric polishing roll can be obtained for polishing high hardness objects with a high polishing load.

The circular nonwoven fabric according to the present embodiment includes, for example, a nonwoven fabric base material and a polishing material retained on the nonwoven fabric base material. The nonwoven fabric base material is a nonwoven fabric made from organic fibers made from a resin such as, for example, polyamide (for example, nylon 6, nylon 6, 6, and so on), polyolefin (for example, polypropylene, polyethylene, and so on), polyester (for example, polyethylene terephthalate, and so on), polycarbonate, and so on. The thickness of the organic fibers can be from 19 to 250 μm in diameter, for example.

The polishing material may be a ceramic abrasive powder made from, for example, SiC, $Al_2O_3$, $Cr_2O_5$, and so on, but there is no limitation to these, and the polishing material can be changed as appropriate in accordance with the object being polished. The diameter of the ceramic abrasive powder can be, for example, from 0.1 to 1000 μm.

The circular nonwoven fabric can be manufactured by, for example, impregnating a nonwoven fabric base material with a polishing compound containing the polishing material, and drying and/or hardening. Examples of polishing compound include the polishing material and a binder polymer such as epoxy resin or phenol resin or the like, and a solvent such as xylene or carbitol or the like, for dissolving the binder polymer, and if necessary a hardening agent may be included.

After impregnating this polishing compound in the nonwoven fabric base material, the solvent is removed and the binder polymer is hardened in, for example, a heating furnace, so that the polishing material is retained on the nonwoven fabric base material.

After the polishing material is retained on the nonwoven fabric base material, the circular nonwoven fabric can be obtained by, for example, carrying out a punching process to produce the shape shown in FIG. 3 on the nonwoven fabric base material in sheet form. Also, the circular nonwoven fabric can be obtained by causing the polishing material to be retained on the nonwoven fabric base material that has been processed to the shape shown in FIG. 3 or the like.

There is no particular limitation on the circular plate according to the present invention provided the compression deformation ratio $T_2$ is smaller than the compression deformation ratio $T_1$, for example, high compression paper, hardboard, plastic board, paper impregnated with phenol resin, if necessary laminated and hardened (paper phenol substrate, bakelite board), fiber reinforced plastic (FRP), veneer board, particle board, metal plate, and so on, formed to the shape illustrated in FIG. 4 can be used.

When polishing using the nonwoven fabric polishing roll, sometimes water is poured onto the surface of the object to be polished while polishing, so preferably the circular plate has water resistance.

The circular nonwoven fabrics 1 and the circular plates 2 are bonded together by adhesive to integrate and fix them. Here, the adhesive may be, for example, an adhesive that includes a hardenable resin and a hardening agent.

The hardenable resin may be, for example, epoxy resin, urea resin, urethane resin, phenol resin, or the like. Of these, the epoxy resin may be a cresol novolac type epoxy resin, a bisphenol A type epoxy resin, a bisphenol F type epoxy resin, a phenol novolac type epoxy resin, a tris(hydroxyphenyl) methane type epoxy resin, a naphthalene type epoxy resin, a fluorene epoxy resin, a glycidylamine compound, and so on.

The hardening agent may be, for example, dicyandiamide (DICY), acid hydrazide, boron trifluoride complex, imidazole compound, amine imide, lead salts, and so on, and of these dicyandiamide is particularly preferred.

The adhesive may, for example, be impregnated in the circular nonwoven fabric prior to stacking, or it may be impregnated in the circular nonwoven fabric after stacking Impregnation in the circular nonwoven fabric can be carried out by, for example, applying an adhesive composition made from the adhesive and a solvent to the circular nonwoven fabric, and drying or the like, if necessary.

FIGS. 5 and 6 are schematic cross-sectional views illustrating an embodiment of the nonwoven fabric polishing roll manufacturing method according to the present invention FIGS. 5 and 6 illustrate a method of manufacturing the nonwoven fabric polishing roll using circular nonwoven fabric 11 and circular plate 21 illustrated in FIG. 3A and FIG. 4.

Figure 5A:
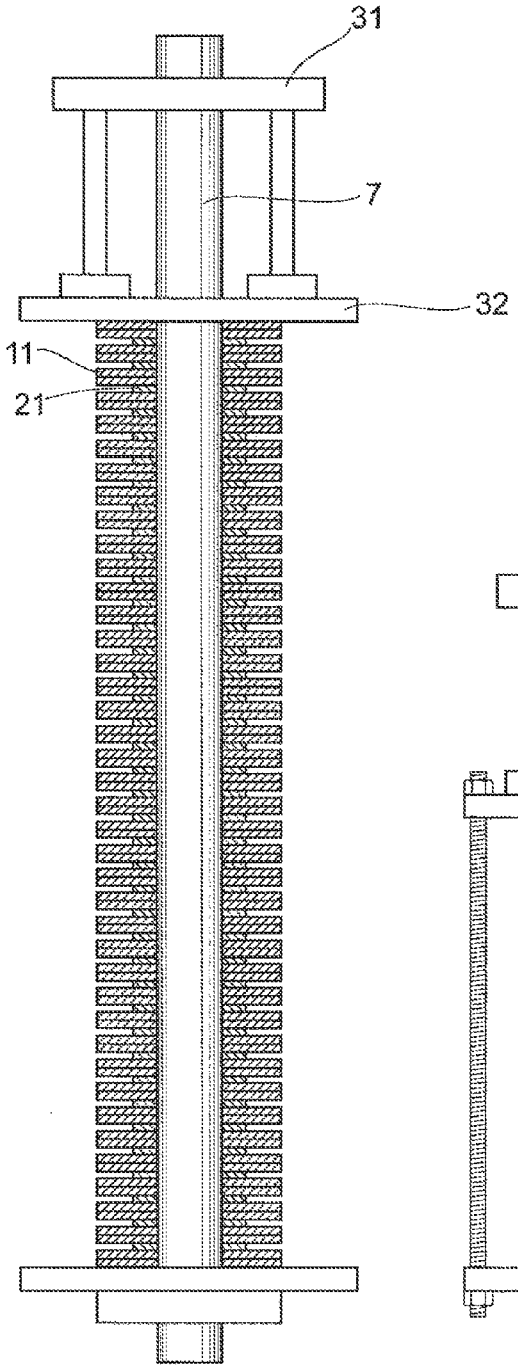
FIG. 5 is a schematic view illustrating an embodiment of the nonwoven fabric polishing roll manufacturing method according to the present invention.

In the manufacturing method according to the present embodiment, first, as illustrated in FIG. 5A, the circular nonwoven fabrics 11 and the circular plates 21 are stacked so that the aperture sides of the circular nonwoven fabrics 11 are sandwiched by the circular plates 21. Here, it is necessary that circular nonwoven fabrics 11 and the circular plates 21 are stacked so that their apertures 14*a* and 24*a* form a through hole in which the rotation shaft 6 is engaged, as illustrated in FIG. 1. Therefore the actual rotation shaft 6 or a dummy shaft 7 with the same shape as the rotation shaft 6 is fitted and the circular nonwoven fabrics 11 and the circular plates 21 are stacked.

The circular nonwoven fabrics 11 and the circular plates 21 stacked using the dummy shaft 7 as the shaft are retained at the two ends in the stacking direction by a retaining fixture 32. Here, the retaining fixture 32 is provided with a through hole in the center through which the dummy shaft 7 is inserted so that the dummy shaft 7 can move freely in the stacking direction (the direction of the axis of the dummy shaft 7).

Figure 5B:
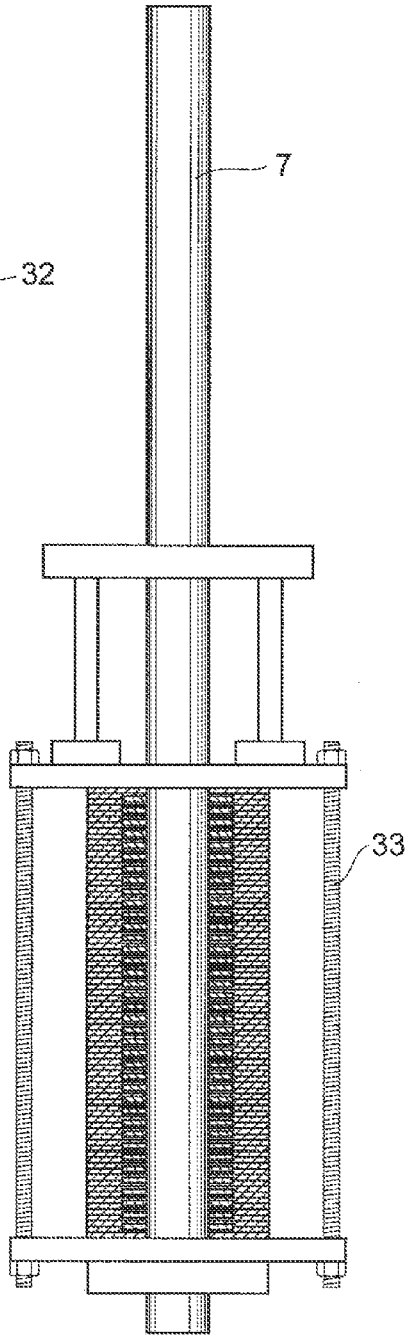

Next, the circular nonwoven fabrics 11 and the circular plates 21 are compressed in the stacking direction by the retaining fixture 32 using pressing means 31 installed on one side of the retaining fixture 32. The compressed circular nonwoven fabrics and the circular plates 21 are fixed using a bolt 33 together with the retaining fixture 32, as illustrated in FIG. 5B.

Figure 6A:
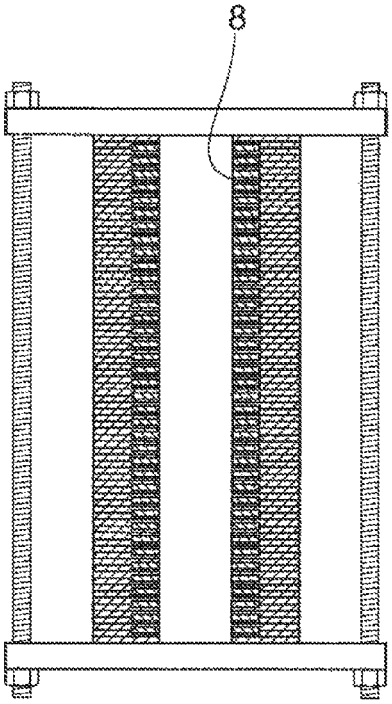
FIG. 6 is a schematic view illustrating an embodiment of the nonwoven fabric polishing roll manufacturing method according to the present invention.

Next, as illustrated in FIG. 6A, the dummy shaft 7 is removed, and the circular nonwoven fabrics 11 and the circular plates 21 are bonded together with adhesive, while being maintained in the compressed state in the stacking direction by the retaining fixture 32. If the circular nonwoven fabrics 11 have been impregnated with adhesive prior to stacking, the circular nonwoven fabrics 11 and the circular plates 21 retained by the retaining fixture 32 as illustrated in FIG. 6A can be placed in a heating furnace for drying and hardening. Also, if the circular nonwoven fabrics 11 have not been impregnated with adhesive prior to stacking, then after impregnating the circular nonwoven fabrics with the adhesive composition while being retained by the retaining fixture 32 as illustrated in FIG. 6A, drying and hardening can be carried out.

Figure 6B:
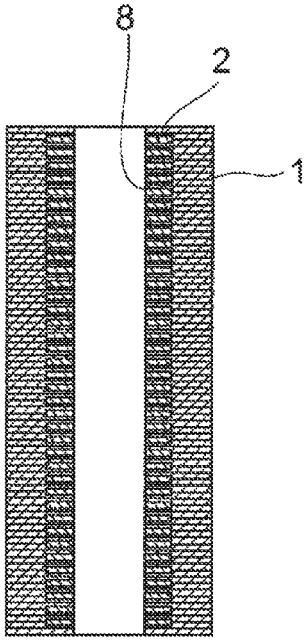
Figure 6C:
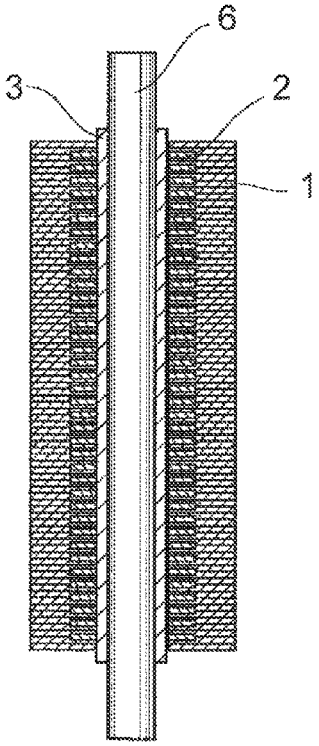

The circular nonwoven fabrics 1 and the circular plates 2 that have been bonded with adhesive as described above have been integrated and fixed, so they can be removed from the retaining fixture as illustrated in FIG. 6B. The nonwoven fabric polishing roll obtained in this way has a through hole 8, so it can be used by inserting the rotation shaft 6 of a polishing machine into the through hole 8, as illustrated in FIG. 6C.

The polishing machine according to the present embodiment includes the nonwoven fabric polishing roll as described above, and can be the same as a polishing machine that includes a conventional polishing roll having a construction different from a nonwoven fabric polishing roll.

Also, according to the present embodiment, it is possible to manufacture a polished article by a manufacturing method that includes a process of polishing the object to be polished using the above nonwoven fabric polishing roll. There is no particular limitation on the object to be polished, but the nonwoven fabric polishing roll according to the present embodiment can be ideally used for polishing objects with a high hardness, so the object for polishing can be, for example, metal strip or the like.

When metal strip is being polished, when a conventional polishing roll is used, the above polishing defects can easily occur. From this point of view also, the nonwoven fabric polishing roll according to the present embodiment can be ideally used for polishing metal strip or the like.

The metal strip may include, for example, strip made from copper, iron, aluminum, or alloys of these, or the like.

Confirmation Tests

The compression deformation ratio was measured as indicated in the following confirmation tests 1 through 8. Then, compression tests were carried out on polishing roll samples as indicated by the following confirmation tests 9 through 13. Then polishing tests were carried out using polishing roll samples as indicated by confirmation tests 14 through 16.

Confirmation Tests 1 through 4

Rectangular nonwoven fabric A (height 20 mm, width 25 mm) with 40 μm thick fiber nonwoven fabric, aluminum oxide particles with a diameter from 75 to 250 micrometers as the polishing material, and phenol resin as the binder polymer were prepared as rectangular nonwoven fabric.

Next, test blocks 1 through 4 with height ($H_1$) 20 mm, width (W) 25 mm, and length (L) 25 mm were prepared using the rectangular nonwoven fabric A, and for each test block the compression deformation ratio $T_1$ was measured in accordance with the above measurement method. The test blocks 1 through 4 were produced with nonwoven fabric densities of 0.5 g/cm$^3$, 0.6 g/cm$^3$, 0.7 g/cm$^3$, and 0.8 g/cm$^3$ respectively. The measured compression deformation ratios are given in Table 1.

Confirmation Test 5

Rectangular board $B_1$ (height 20 mm, width 25 mm) made from high compression paper of thickness 2.5 mm was prepared as the rectangular plates. Next, a test block 5 was prepared using the rectangular board $B_1$ with a height ($H_1$) 20 mm, width (W) 25 mm, and length (L) 25 mm, and the compression deformation ratio $T_2$ was measured using the above measuring method. The measured compression deformation ratios are given in Table 1.

Confirmation Test 6

Rectangular board $B_2$ (height 20 mm, width 25 mm) made from bakelite board of thickness 2 mm was prepared as the rectangular plates. Next, a test block 6 was prepared using the rectangular board $B_1$ with a height ($H_1$) 20 mm, width (W) 25 mm, and length (L) 25 mm, and the compression deformation ratio $T_2$ was measured using the above measuring method. The measured compression deformation ratios are given in Table 1.

Confirmation Test 7

Rectangular nonwoven fabric A and rectangular plate $B_1$ were alternately stacked (in this example they were alternately stacked in the ratio 2:1), and compressed in the stacking direction and bonded with adhesive so that the nonwoven fabric density of the rectangular nonwoven fabric A sandwiched by the rectangular plate $B_1$ was 0.8 g/cm$^3$, to produce test block 7 with a height ($H_1$) 20 mm, width (W) 25 mm, and length (L) 25 mm. In test block 7 which was produced, the rectangular plates $B_1$ were stacked at the rate 160 per meter in the stacking direction. The compression deformation ratio of test block 7 was measured as for confirmation tests 1 through 6. The measured compression deformation ratios are given in Table 1.

Confirmation Test 8

Rectangular nonwoven fabric A and rectangular plate $B_2$ were alternately stacked (in this example they were alternately stacked in the ratio 2:1), and compressed in the stacking direction and bonded with adhesive so that the nonwoven fabric density of the rectangular nonwoven fabric A sandwiched by the rectangular plate $B_2$ was 0.7 g/cm$^3$, to produce test block 8 with a height ($H_1$) 20 mm, width (W) 25 mm, and length (L) 25 mm. In test block 8 which was produced, the rectangular plates $B_2$ were stacked at the rate 160 per meter in the stacking direction. The compression deformation ratio of test block 8 was measured as for confirmation tests 1 through 6. The measured compression deformation ratios are given in Table 1.

TABLE 1

| | | Compression deformation ratio (%) |
|---|---|---|
| Nonwoven fabric (density 0.5) | Test block 1 | 7.7 |
| (Density 0.6) | Test block 2 | 4.1 |
| (Density 0.7) | Test block 3 | 3.1 |
| (Density 0.8) | Test block 4 | 2.9 |
| High compression paper | Test block 5 | 1.6 |
| Bakelite plate | Test block 6 | 0.8 |

TABLE 1-continued

| | | Compression deformation ratio (%) |
|---|---|---|
| Nonwoven fabric + high compression paper | Test block 7 | 2.1 |
| Nonwoven fabric + Bakelite plate | Test block 8 | 1.6 |

Confirmation Tests 9 through 11

Figure 8B:
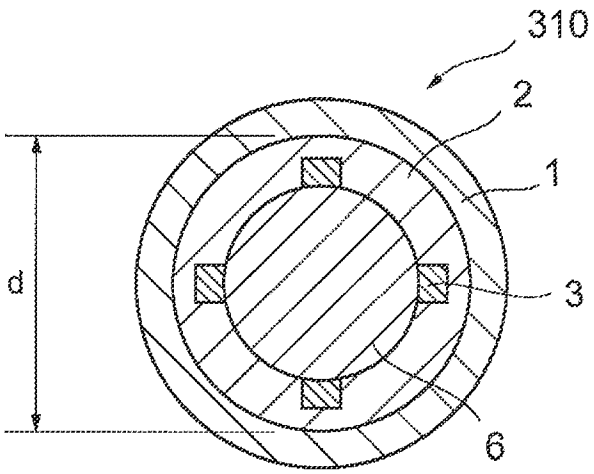
FIG. 8 is a schematic cross-sectional view illustrating a polishing roll sample used in the confirmation tests.
Figure 8A:
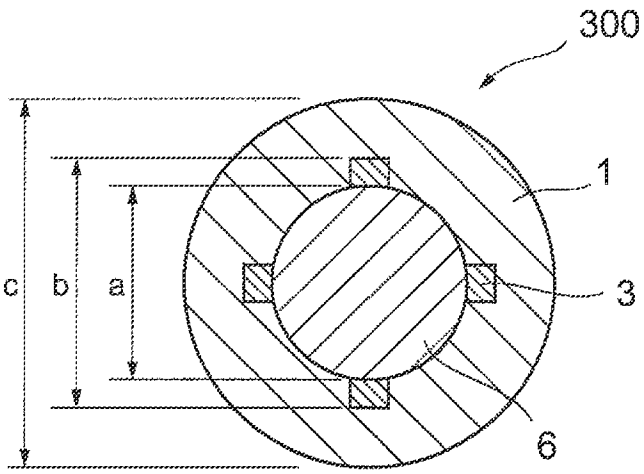

FIG. 8A is a schematic cross-sectional view of a small scale polishing roll sample used in confirmation test 9. In a polishing roll sample 300, the circular nonwoven fabric 1 only was stacked. In the polishing roll sample 300, the circular nonwoven fabric 1 was compressed in the stacking direction and bonded together with adhesive so that the nonwoven fabric density was 0.5 g/cm$^3$. The same material as rectangular nonwoven fabric A of confirmation tests 1 through 4 was used as the circular nonwoven fabric 1.

FIG. 8B is a schematic cross-sectional view of a small scale polishing roll sample used in confirmation tests 10 and 11. In a polishing roll sample 310, the circular nonwoven fabric 1 and the circular plates 2 were stacked alternately, and the circular nonwoven fabric 1 and circular plates 2 were compressed in the stacking direction and bonded together with adhesive so that the nonwoven fabric density at the outer periphery of the polishing roll sample 310 was 0.5 g/cm$^3$. The same material as rectangular nonwoven fabric A of confirmation tests 1 through 4 was used as the circular nonwoven fabric 1. Also, circular plates made from high compression paper that was the same as the rectangular plates $B_1$ were used as the circular plates 2 in confirmation test 10, and circular plates made from bakelite plates that were the same as the rectangular plates $B_2$ were used in confirmation test 11. In the following, the polishing roll sample of confirmation test 10 is referred to as "polishing roll sample 311", and the polishing roll sample of confirmation test 11 is referred to as "polishing roll sample 312".

Polishing roll sample 300, polishing roll sample 311, and polishing roll sample 312 each designed to have a through hole into which a rotation shaft 6 with a diameter a of 147 mm and a length b including key projections 170 was inserted, and an external diameter c of 230 mm. Also, the external diameter of the circular plates 2 of the polishing roll sample 311 and the polishing roll sample 312 was 210 mm. In this example a width of 100 mm was used.

Figure 9A:
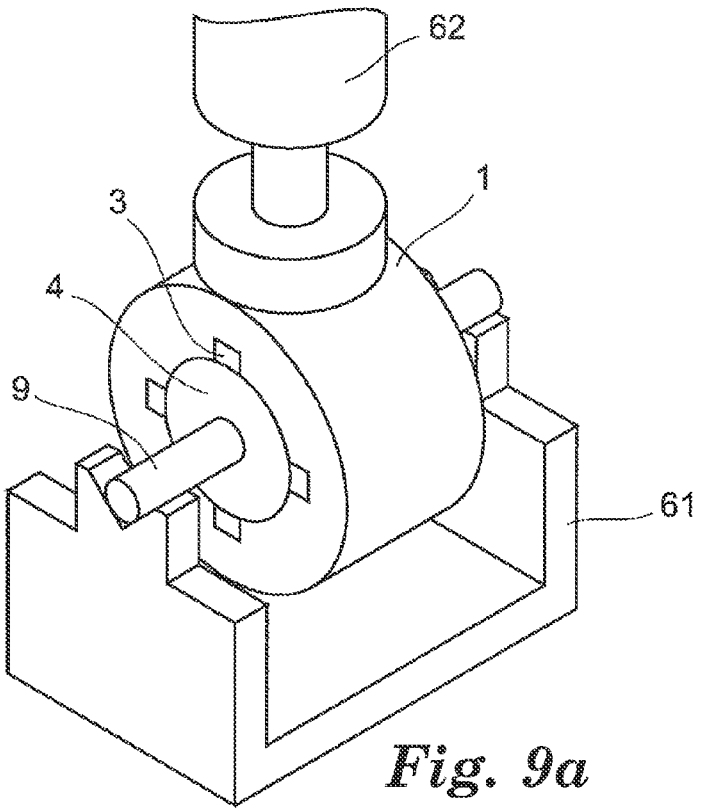
FIG. 9 is a schematic view illustrating an outline of the compression test carried out in the confirmation tests.

Compression tests were carried out on each of the above polishing roll samples as illustrated in FIG. 9A. In the compression tests, the polishing roll samples were installed in a retaining fixture 61, and compressed with a predetermined compression load by a compression machine 62. The compression load was varied from 3 N to 1000 N, and the compression strain was measured at each compression load. The polishing roll samples were suported in the retaining fixture 61 by a shaft 9 that extended from the rotation shaft.

Figure 9B:
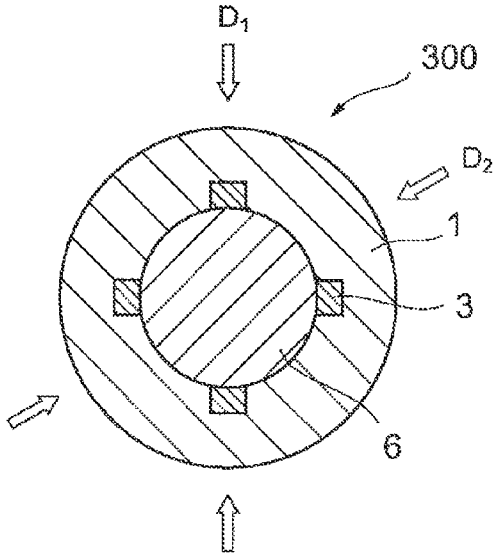

The compression tests were carried out in two directions, as illustrated in FIG. 9B: the direction with the keys (key direction) $D_1$ and the direction without the keys (between the keys direction) $D_2$, and the difference in the compression strain due to the compression direction was compared. The compression strains for polishing roll sample 310 in each direction are given in Table 2, the compression strains for polishing roll sample 311 in each direction are given in Table 3, and the compression strains for polishing roll sample 312 in each direction are given in Table 4.

TABLE 2

| Polishing roll sample 310 (units: mm) | | |
|---|---|---|
| Compression load (N) | Key direction | Between the keys direction |
| 3 | 0.00 | 0.00 |
| 10 | 0.12 | 0.12 |
| 20 | 0.17 | 0.16 |
| 50 | 0.22 | 0.22 |
| 100 | 0.27 | 0.26 |
| 200 | 0.33 | 0.34 |
| 300 | 0.39 | 0.41 |
| 400 | 0.45 | 0.47 |
| 500 | 0.50 | 0.53 |
| 600 | 0.55 | 0.59 |
| 700 | 0.60 | 0.64 |
| 800 | 0.65 | 0.69 |
| 900 | 0.69 | 0.74 |
| 1000 | 0.74 | 0.79 |

TABLE 3

| Polishing roll sample 311 (units: mm) | | |
|---|---|---|
| Compression load (N) | Key direction | Between the keys direction |
| 3 | 0.00 | 0.00 |
| 10 | 0.10 | 0.11 |
| 20 | 0.15 | 0.15 |
| 50 | 0.20 | 0.20 |
| 100 | 0.24 | 0.25 |
| 200 | 0.30 | 0.31 |
| 300 | 0.35 | 0.35 |
| 400 | 0.39 | 0.39 |
| 500 | 0.43 | 0.43 |
| 600 | 0.47 | 0.47 |
| 700 | 0.50 | 0.51 |
| 800 | 0.54 | 0.55 |
| 900 | 0.58 | 0.58 |
| 1000 | 0.61 | 0.62 |

TABLE 4

| Polishing roll sample 312 (units: mm) | | |
|---|---|---|
| Compression load (N) | Key direction | Between the keys direction |
| 3 | 0.00 | 0.00 |
| 10 | 0.13 | 0.12 |
| 20 | 0.18 | 0.17 |
| 50 | 0.23 | 0.22 |
| 100 | 0.28 | 0.27 |
| 200 | 0.34 | 0.33 |
| 300 | 0.39 | 0.38 |
| 400 | 0.43 | 0.43 |
| 500 | 0.46 | 0.47 |
| 600 | 0.51 | 0.51 |
| 700 | 0.55 | 0.55 |
| 800 | 0.59 | 0.59 |
| 900 | 0.62 | 0.63 |
| 1000 | 0.66 | 0.67 |

Figure 11:
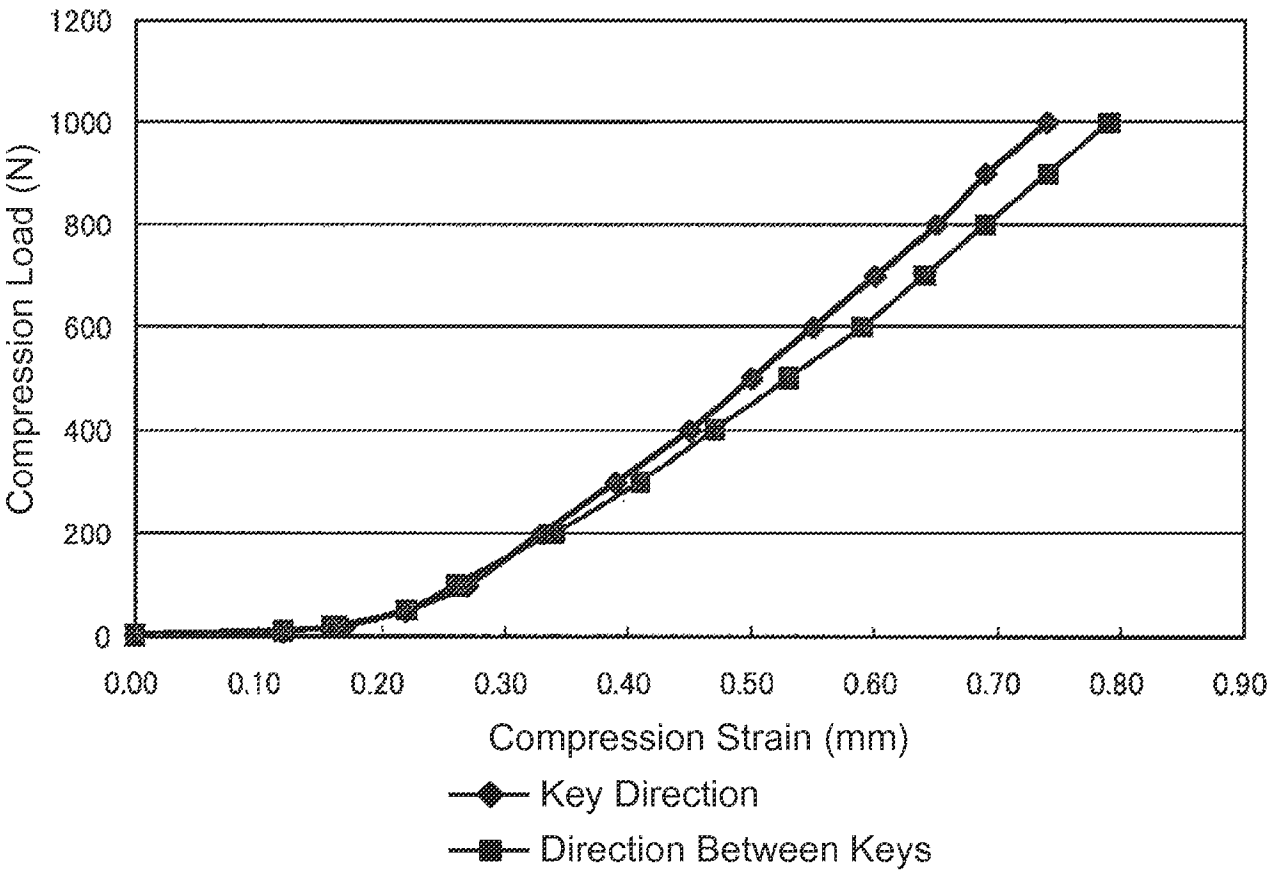
FIG. 11 illustrates the relationship between the compressive strain and the compression load in confirmation test 9.
Figure 12:
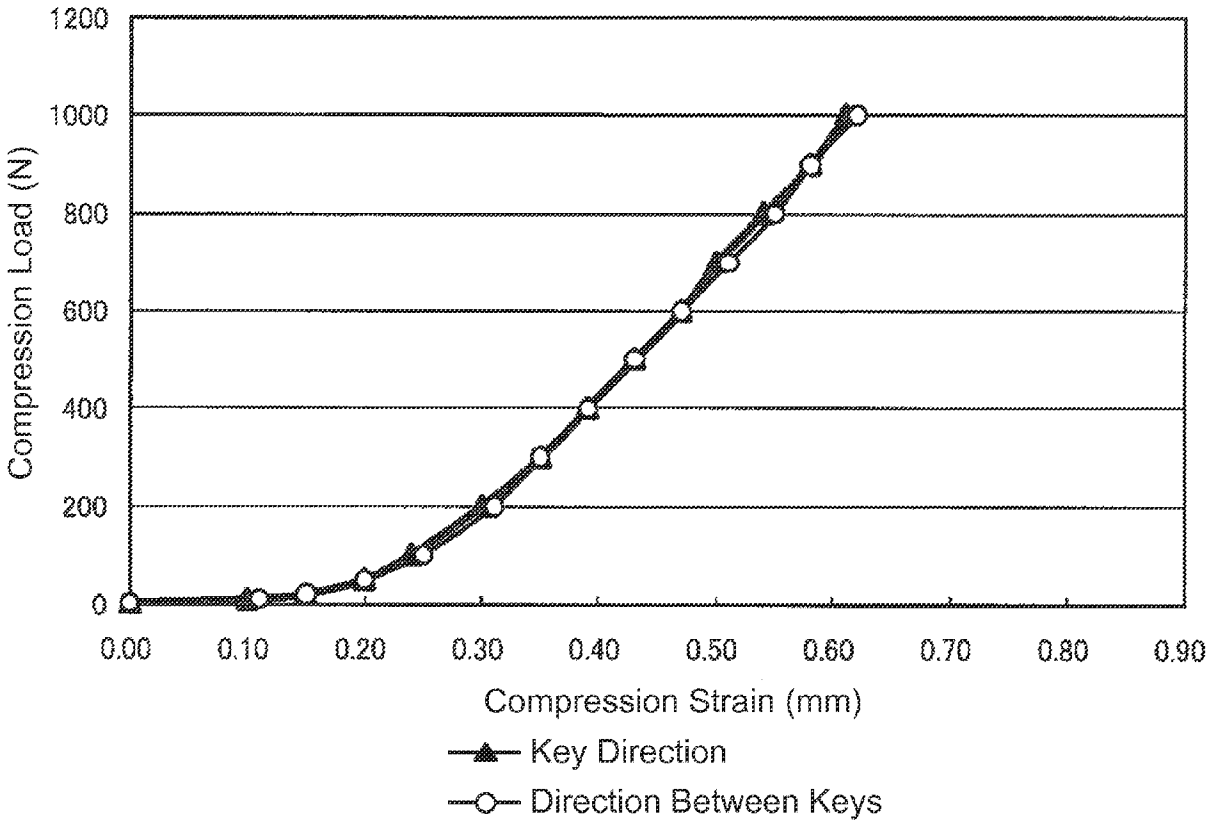
FIG. 12 illustrates the relationship between the compressive strain and the compression load in confirmation test 10.
Figure 13:
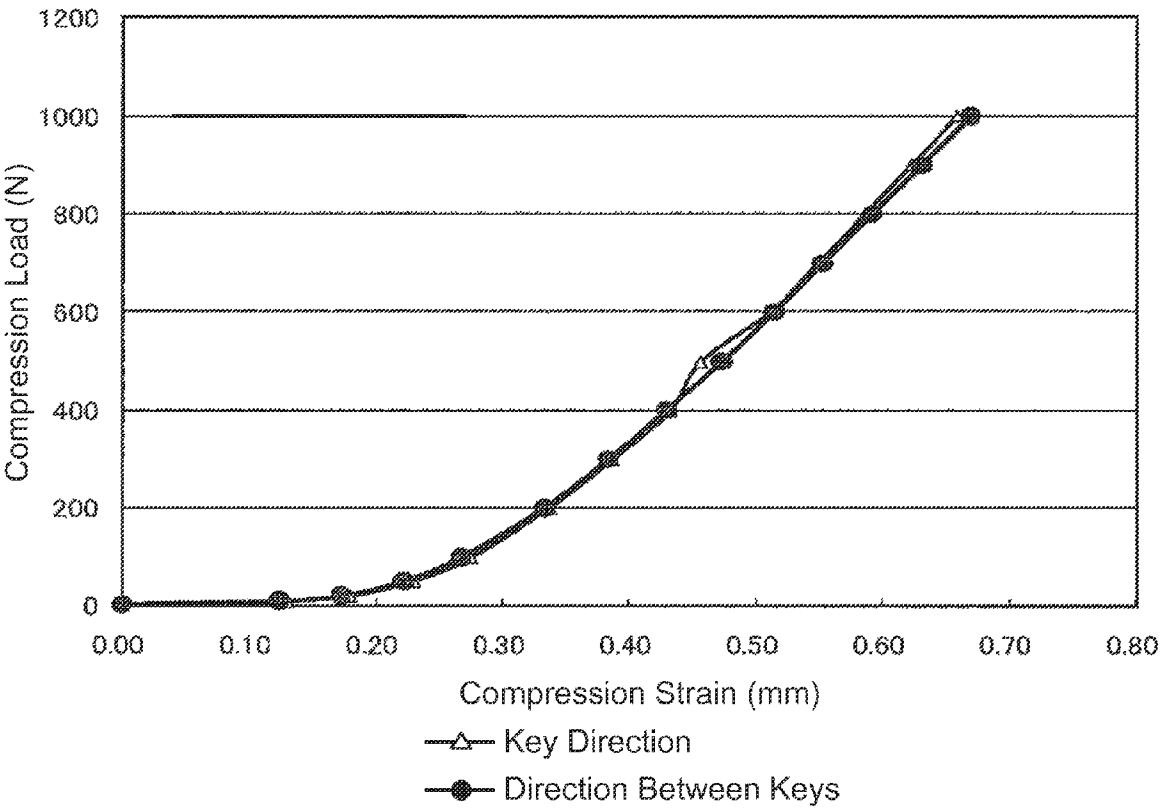
FIG. 13 illustrates the relationship between the compressive strain and the compression load in confirmation test 11.

FIGS. 11 through 13 are graphs illustrating the relationship between the compression strain and compression load for each polishing roll sample. As illustrated in FIG. 11, in the polishing roll samples 300 with no circular plates, there was a difference in the compression strain between the key direction and the between the keys direction. Also, the difference increased the greater the compression load. On the other hand, as illustrated in FIG. 12 and FIG. 13, in the polishing roll samples 311 and 312 having the circular plates, there was almost no difference in compression strain between the key direction and the between the keys direction.

Confirmation Test 12

A polishing roll sample that was the same as the polishing roll sample 300 of confirmation test 9 was immersed in water for 12 hours, to produce polishing roll sample 301. Compression tests similar to those described above were carried out on polishing roll sample 301, and the differences in the compression strain in the key direction and the between the keys direction were compared. The results are given in Table 5.

Confirmation Test 13

A polishing roll sample that was the same as the polishing roll sample 312 of confirmation test 11 was immersed in water for 12 hours, to produce polishing roll sample 313. Compression tests similar to those described above were carried out on polishing roll sample 303, and the differences in the compression strain in the key direction and the between the keys direction were compared. The results are given in Table 6.

TABLE 5

| Polishing roll sample 301 (units: mm) | | |
|---|---|---|
| Compression load (N) | Key direction | Between the keys direction |
| 3 | 0.00 | 0.00 |
| 10 | 0.13 | 0.12 |
| 20 | 0.18 | 0.17 |
| 50 | 0.25 | 0.24 |
| 100 | 0.32 | 0.32 |
| 200 | 0.43 | 0.45 |
| 300 | 0.52 | 0.55 |
| 400 | 0.60 | 0.65 |
| 500 | 0.68 | 0.74 |
| 600 | 0.76 | 0.83 |
| 700 | 0.84 | 0.92 |
| 800 | 0.91 | 1.00 |
| 900 | 0.98 | 1.09 |
| 1000 | 1.06 | 1.17 |

TABLE 6

| Polishing roll sample 313 (units: mm) | | |
|---|---|---|
| Compression load (N) | Key direction | Between the keys direction |
| 3 | 0.00 | 0.00 |
| 10 | 0.16 | 0.14 |
| 20 | 0.21 | 0.19 |
| 50 | 0.27 | 0.24 |
| 100 | 0.33 | 0.30 |
| 200 | 0.40 | 0.38 |
| 300 | 0.46 | 0.44 |
| 400 | 0.52 | 0.49 |
| 500 | 0.57 | 0.55 |
| 600 | 0.62 | 0.60 |
| 700 | 0.67 | 0.65 |
| 800 | 0.71 | 0.70 |
| 900 | 0.76 | 0.75 |
| 1000 | 0.81 | 0.80 |

Figure 14:
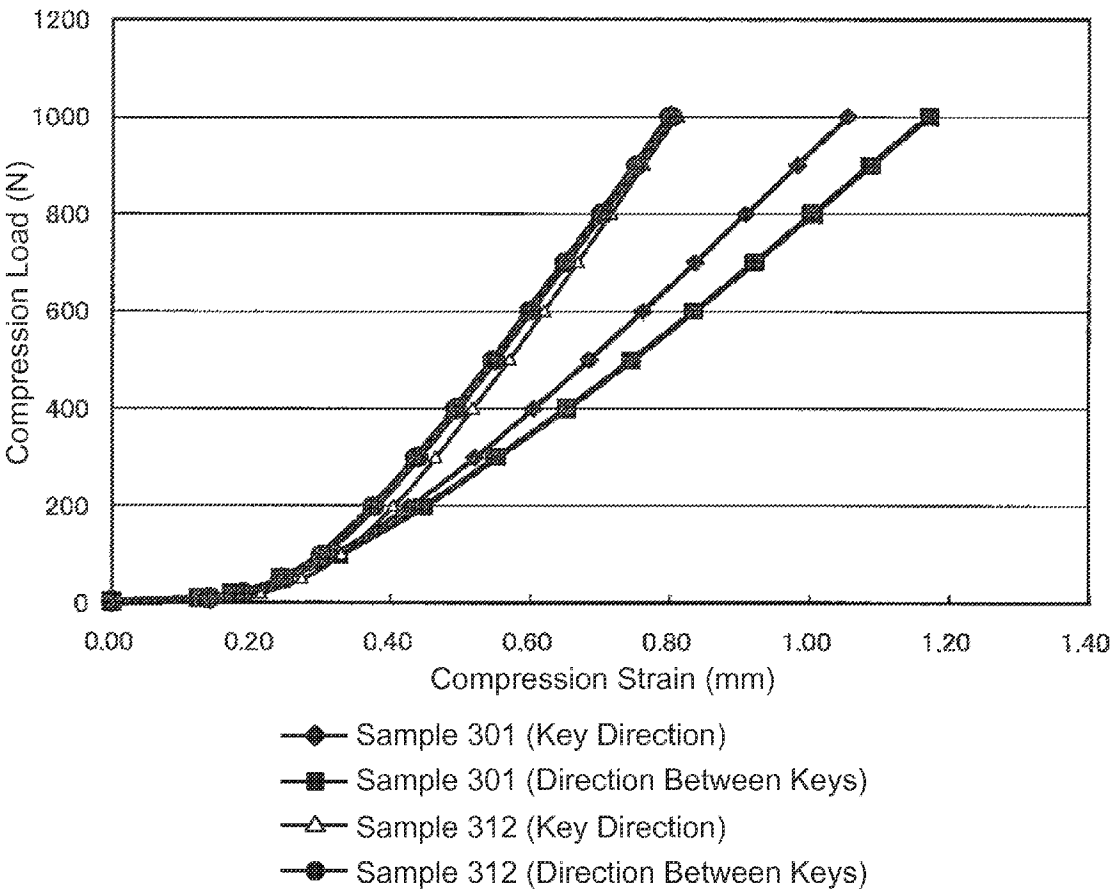
FIG. 14 illustrates the relationship between the compressive strain and the compression load in confirmation tests 12 and 13.

FIG. 14 is a graph illustrating the relationship between the compression strain and compression load for polishing roll samples 301 and 313. As illustrated in FIG. 14, in the polishing roll samples 303 with no circular plates, there was a difference in the compression strain between the key direction and the between the keys direction. Also, the difference increased the greater the compression load. On the other hand, in the polishing roll samples 313 having the circular plates, even after immersion in water there was almost no difference in compression strain between the key direction and the between the keys direction.

Confirmation Tests 14 through 16

Figure 10:
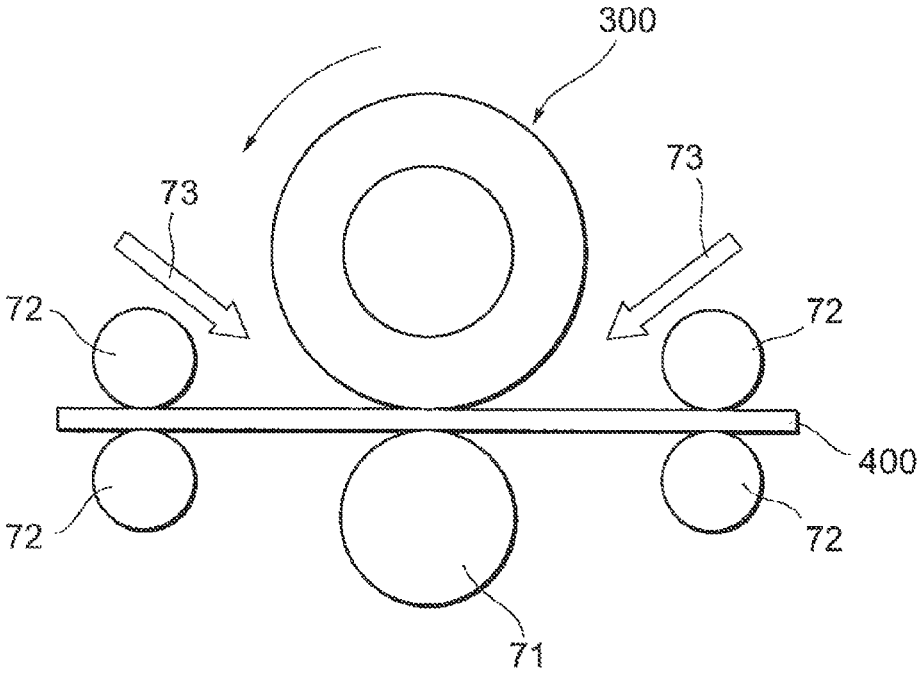
FIG. 10 is a schematic view illustrating an outline of the metal strip polishing carried out in the confirmation tests.

Metal strip was polished using the polishing roll samples produced in confirmation tests 9 through 11. First, a metal plate 400 was polished using the polishing roll sample 300 as illustrated in FIG. 10. The polishing roll sample 300 was installed in a plane polishing machine via the rotating shaft, and rotated in the direction indicated by the arrow in FIG. 10 to polish a metal plate 400. The metal plate 400 was transported at a constant transport speed by pinch rolls 72 of the plane polishing machine, and supported by a back up roll 71 installed in a position in opposition to the polishing roll sample 300. Also, a lubricating material 73 was injected into the position where the polishing roll sample 300 and the metal plate 300 contacted. The metal plate was polished under the following conditions.

Polishing Conditions

Polishing machine: Plane polishing machine
Rotation speed: 1700 rpm
Transport speed: 60 m/min.
Polishing load: 600 N in a width of 100 mm
Number of times polished: 1 time
Lubricating material: Water
Metal plate: Stainless steel plate (material: SUS 304, size: 150×700×1 mm)

Next, the polishing roll sample 300 was replaced with the polishing roll samples 311 and 312, and a metal plate was polished in the same way. For the metal plate polished by each polishing roll, the presence or absence of polishing defects such as chatter marks and so on was checked. The results are given in Table 7.

TABLE 7

| | Results of observation of polished plates |
|---|---|
| Polishing roll sample 300 | Chatter marks were observed. |
| Polishing roll sample 311 | Chatter marks were not observed, uniform finish was obtained. |
| Polishing roll sample 312 | Chatter marks were not observed, and a uniform finish was obtained. |

In the above the preferred embodiments of the present invention were explained, but the present invention is not limited to these embodiments.

According to the present invention, it is possible to provide a nonwoven fabric polishing roll and manufacturing method of same that can reduce the occurrence of polishing defects and carry out uniform polishing, and provide a polishing machine that includes the nonwoven fabric polishing roll and manufacturing method of a polished article using the nonwoven fabric polishing roll, so the present invention has industrial applicability.

What is claimed is:

1. A nonwoven fabric polishing roll having a through hole into which a rotation shaft of a polishing machine is inserted, and the internal surface of the through hole engages with the rotation shaft so that the torque of the rotation shaft is transmitted, the nonwoven fabric polishing roll comprising:

a plurality of circular nonwoven fabrics having an aperture in the center thereof that forms the through hole; and a plurality of circular plates having an aperture in the center thereof that forms the through hole, and having an outer diameter that is smaller than an outer diameter of the circular nonwoven fabric, wherein, the plurality of circular nonwoven fabric and the plurality of the circular plates are stacked so that one or two or more of the circular nonwoven fabrics are sandwiched on their aperture side by the circular plates, and bonded together with an adhesive while compressed in a stacking direction, whereby adjacent surfaces of the circular nonwoven fabric are directly bonded together, and a compression deformation ratio of the circular plates with respect to pressure forces from a direction normal to the stacking direction is smaller than that of the circular nonwoven fabric.

2. The nonwoven fabric polishing roll according to claim 1, wherein a total thickness of the stacked circular plates per meter in the stacking direction is from 10 to 60 cm.

3. The nonwoven fabric polishing roll according to claim 1, wherein the circular plates are stacked at approximately equal intervals.

4. The nonwoven fabric polishing roll according to claim 1, wherein the shortest distance from the aperture of the circular plate to the outer periphery of the circular plate is greater than or equal to 5 mm.

5. A method of manufacturing a nonwoven fabric polishing roll having a through hole into which a rotation shaft of a polishing machine is inserted, and the internal surface of the through hole engages with the rotation shaft so that the torque of the rotation shaft is transmitted, the method comprising:

a stacking process of stacking a plurality of circular nonwoven fabrics having an aperture in the center thereof that forms the through hole and a plurality of circular plates having an aperture in the center thereof that forms the through hole, so that one or two or more of the circular nonwoven fabrics are sandwiched on their aperture side by the circular plates, and a bonding process of bonding together the circular nonwoven fabric and circular plates that were stacked in the stacking process with an adhesive while compressed in a stacking direction, thereby bonding adjacent surfaces of the circular nonwoven fabric directly together, wherein, the circular plates have an outer diameter smaller than the outer diameter of the circular nonwoven fabric, and a compression deformation ratio with respect to pressure forces from a direction normal to the stacking direction smaller than that of the circular nonwoven fabric.

6. The nonwoven polishing roll according to claim 1, wherein the circular nonwoven fabrics are impregnated with the adhesive.

7. The nonwoven polishing roll according to claim 1, wherein an outer periphery of immediately adjacent ones of the circular nonwoven fabrics are directly bonded together.

8. The nonwoven polishing roll according to claim 1, wherein a shape of the aperture in the center of each of the circular nonwoven fabrics is the same as a shape of the aperture in the center of each of the circular plates.

9. The nonwoven polishing roll according to claim 1, wherein each of the plurality of circular nonwoven fabrics includes a polishing material retained on a nonwoven fabric base material.

10. The nonwoven polishing roll according to claim 9, wherein the polishing material includes a ceramic abrasive powder.

11. The nonwoven polishing roll according to claim 9, wherein the circular nonwoven fabrics and the circular plates are stacked at a 2:1 ratio.

12. The method according to claim 5, wherein the step of bonding includes impregnating the plurality of circular non-woven fabrics with the adhesive.

* * * * *

UNITED STATES PATENT AND TRADEMARK OFFICE

CERTIFICATE OF CORRECTION

PATENT NO. : 9,248,551 B2
APPLICATION NO. : 13/982772
DATED : February 2, 2016
INVENTOR(S) : Masashi Nakayama et al.

It is certified that error appears in the above-identified patent and that said Letters Patent is hereby corrected as shown below:

In the specification

Column 6
Line 51, delete "*T1=(H1–H2)×100/Hi*" and insert -- *T1=(H1–H2)×100/H1* --, therefor.

Column 9
Line 40, after "stacking" insert -- . --.

Column 15
Line 39, after "observed," insert -- and a --.

Signed and Sealed this
Ninth Day of August, 2016

Michelle K. Lee

Michelle K. Lee
*Director of the United States Patent and Trademark Office*